United States Patent [19]

Pronzati

[11] 4,385,776

[45] May 31, 1983

[54] SKI STICKS PROVIDED WITH INTERCHANGEABLE WHEELS

[76] Inventor: Attilio Pronzati, Via Mazzini, 16, 20010 Vanzago (Milano), Italy

[21] Appl. No.: 237,738

[22] Filed: Feb. 24, 1981

[30] Foreign Application Priority Data

Feb. 29, 1980 [IT] Italy ..... 20275 A/80

[51] Int. Cl.[3] ..... A63C 11/24

[52] U.S. Cl. ..... 280/824

[58] Field of Search ..... 280/824, 823; 135/76, 135/78

[56] References Cited

U.S. PATENT DOCUMENTS

| | | | |
|---|---|---|---|
| 1,342,320 | 6/1920 | Beehler | 135/76 |
| 2,741,485 | 4/1956 | Storm et al. | 280/824 |

FOREIGN PATENT DOCUMENTS

| | | | |
|---|---|---|---|
| 2055553 | 5/1972 | Fed. Rep. of Germany | 280/823 |
| 2905147 | 8/1980 | Fed. Rep. of Germany . | |
| 855354 | 5/1940 | France . | |
| 2173909 | 10/1973 | France . | |
| 254832 | 1/1949 | Switzerland . | |
| 436072 | 11/1967 | Switzerland . | |
| 598842 | 5/1978 | Switzerland . | |

*Primary Examiner*—David M. Mitchell
*Assistant Examiner*—Kenneth R. Rice
*Attorney, Agent, or Firm*—Young & Thompson

[57] ABSTRACT

This invention relates to ski sticks which are provided with interchangeable wheels fitted with fastening structure engaging in corresponding structure integral with the stick rod, which are of complementary shape to the former and are such as to releasably engage therein, so as to clamp said wheel to the stick rod.

3 Claims, 3 Drawing Figures

SKI STICKS PROVIDED WITH INTERCHANGEABLE WHEELS

This invention relates to long distance ski sticks comprising a rod and a wheel, each of which has disengageable mutual fastening means.

For sportsmen practising long distance sport skiing there is the need to use, under different snow conditions, such as new snow on unbeaten track, heavy snow on beaten track and so on, sticks provided with wheels having different surfaces. Thus, it is required that wheels should have a larger surface for new snow, and a smaller surface when being used on beaten track.

At present, such ski sticks require complicated assembling and disassembling operations which are difficult to be carried out in the open air under any atmospheric condition.

Therefore, it is the primary object of the present invention to provide ski sticks, in which the wheels can be very readily replaced.

It is another object of the present invention to enhance the ease of such a replacement, which anyone can perform for without any fixtures or implements and which is quite inexpensive. Particularly, the novel interchangeable wheel should be such that the manufacturing thereof would be almost at the same cost as normal or standard wheels.

The above mentioned objects have been accomplished by providing a ski stick, in which the rod thereof at one of its ends and the wheel which is applied to said end both have trigger-type disengageable mutal fastening means.

A preferred embodiment of the invention contemplates that said fastening means are such that the connection automatically occurs upon assembling of the wheel on the rod, whereas disconnection occurs by operation of a lever or the like which is integral with said stick, particularly integral with said wheel.

A particular embodiment of the invention contemplates that the fastening means on the rod merely comprise a sloping surface terminating with a tooth, whereas the fastening means on the wheel comprise a V-shaped lever, in which the end of one leg of the V is secured to the wheel, whereas the other V-leg will be effective as an operating lever, the apex of this V serving as a connection means which will be inserted behind said tooth on the rod.

A further preferred embodiment of the invention provides that the connecting device on the wheel is a different colour, so that is made more evident or visible.

The invention will now be further explained in connection with an exemplary embodiment which has been shown on the accompanying drawing, in which.

Figure 1:
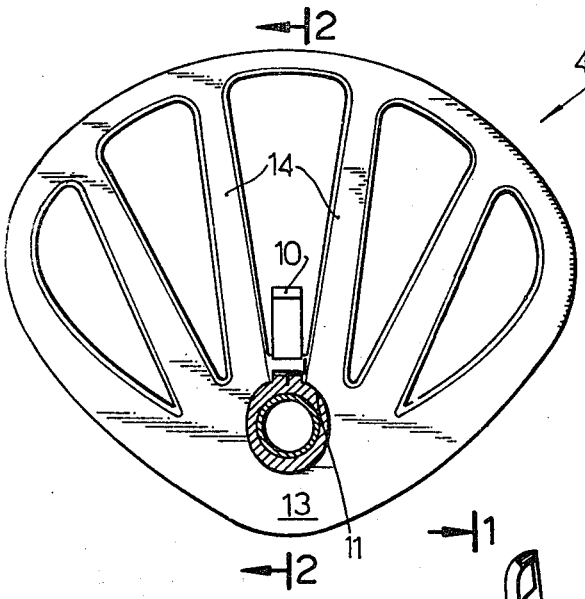
FIG. 1 is a sectional view of a ski stick taken along line 1—1 of FIG. 2.
Figure 2:
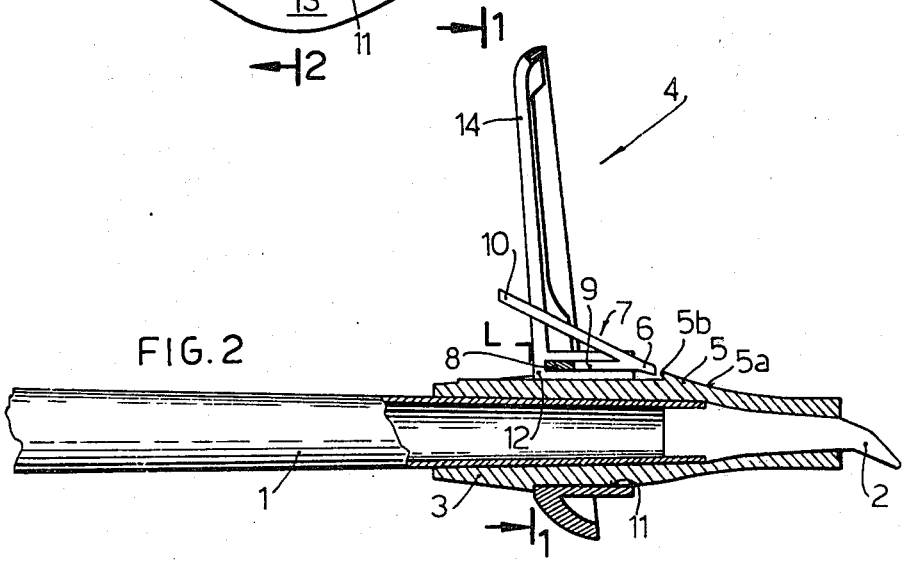
FIG. 2 is a longitudinal sectional view of the same stick taken along line 2—2 of FIG. 1.

Referring to the figures of the accompanying drawing, it will be seen that reference numeral 1 designates the metal rod of the stick, 2 its ferrule, 3 a sleeve integral with rod 1, while reference numeral 4 generally designates the wheel having spokes 14 merging in the zone 13, at which a hole 11 is provided for fastening said wheel 4 to said rod 1.

Said sleeve 3 has a circular inner hole for accomodation on said rod 1, while being at the outside of oval or in any case asymmetrical shape for presetting said wheel 4 at a given particular position, as ordinarily used in sticks for long distance skiing. Where this would not be the case or required, both of the sections could be round sections.

Said sleeve 3 also has a tooth 5 having a wall 5*a* smoothly sloping towards the rod ferrule, and a wall 5*b* forming an abutment.

This wheel 4 is at one zone 12 thereof located in proximity to its hole 11 integral with the end 8 of a leg 9 of a V-shaped fastening means 7, the apex of which comprising the junction location of the two legs is made to operate as a hook 6. Said leg 9 is connected by its fixed portion 8 to said wheel 4, whereas the other leg is further extended and operates as an operating lever 10 for said hook 6.

Figure 3:
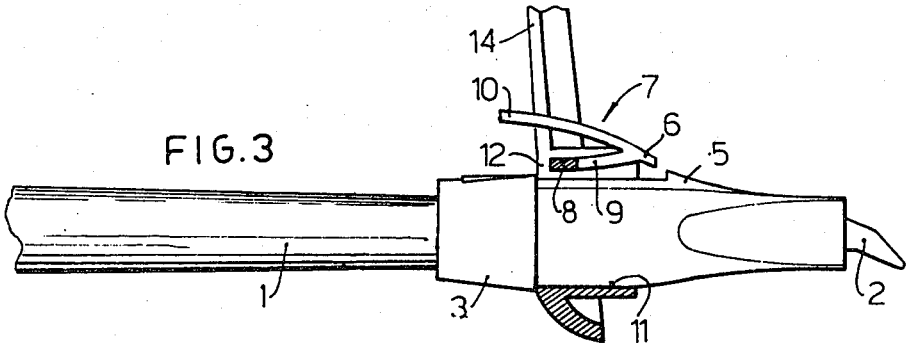
FIG. 3 is a fragmentary longitudinal sectional view taken along line 2—2 of FIG. 1, but at a different operating position, when desiring to disengage the wheel.

The mode of operation of a ski stick according to the present invention is very simple: by lowering said lever 10, as shown in FIG. 3, said hook 6 moves away from tooth 5 releasing said wheel 4 which can be removed from said rod 1. By threading a new wheel 4 on rod 1, the sloping wall 5*a* of tooth 5 causes hook 6 to be resiliently outwardly shifted and then returned to clamping position as soon as it has moved beyond said abutment 5*b*.

This invention embraces all of those changes in detail which may become evident to those skilled in the art. Particularly, said fastening means could be made, just in a reverse way, for example by providing that said hook is applied to the rod rather than to the wheel.

What I claim is:

1. A long distance ski stick comprising a rod and a wheel having disengageable mutual fastening means, said fastening means comprising an abutment on the rod, and a trigger-type releasable latch on the wheel that is urged toward the rod and that slides over the abutment when the rod is inserted through the wheel and that snaps behind the abutment to retain the wheel on the rod until the latch is released, the latch comprising a lever integral with the wheel, said lever having a first free end engaging the said abutment and a second free end on which the user presses to release the latch.

2. A ski stick according to claim 1, wherein the latch is a V-shaped element, in which one of the legs is at its end integral with said wheel, while the V apex forms said first free end and is effective as a hook which snaps behind said abutment, whereas the other leg forms said second free end to operate as a lever for displacing said apex of the V-shaped element.

3. A ski stick according to claim 1, wherein the fastening means on the wheel is made of a color different from the remaining portion of the wheel, so that it can be more easily recognized.

* * * * *